US006475035B1

(12) United States Patent
Warislohner

(10) Patent No.: US 6,475,035 B1
(45) Date of Patent: Nov. 5, 2002

(54) MULTIPOLAR PLUG-IN CONNECTION

(75) Inventor: Josef Warislohner, Kirchseeon-Eglharting (DE)

(73) Assignee: W. W. Fischer SA, Apples (CH)

( * ) Notice: Subject to any disclaimer, the term of this patent is extended or adjusted under 35 U.S.C. 154(b) by 0 days.

(21) Appl. No.: 09/786,857

(22) PCT Filed: Oct. 15, 1999

(86) PCT No.: PCT/EP99/07843

§ 371 (c)(1),
(2), (4) Date: Mar. 12, 2001

(87) PCT Pub. No.: WO00/25390

PCT Pub. Date: May 4, 2000

(30) Foreign Application Priority Data

Oct. 22, 1998 (DE) ..... 198 48 835

(51) Int. Cl.[7] ..... H01R 13/648
(52) U.S. Cl. ..... 439/609
(58) Field of Search ..... 439/609, 607

(56) References Cited

U.S. PATENT DOCUMENTS 2,750,572 A 12/1956 Fox ..... 339/185
4,412,717 A 11/1983 Monroe ..... 339/177 R
4,470,657 A * 9/1984 Deacon ..... 439/609
4,934,963 A 6/1990 Gardner et al. ..... 439/677
5,932,841 A * 8/1999 Matsumoto et al. ..... 174/35 C

FOREIGN PATENT DOCUMENTS

| | | |
|---|---|---|
| DE | 1084803 | 4/1960 |
| DE | 2-3026563 | 5/1988 |
| FR | 586049 | 3/1925 |
| JP | 241763 | 9/1996 |

OTHER PUBLICATIONS

Part L of Catalogue by WW Fischer SA, p. 4 (1997).

* cited by examiner

*Primary Examiner*—Tho D. Ta
*Assistant Examiner*—Ann McCamey
(74) *Attorney, Agent, or Firm*—Birch, Stewart, Kolasch & Birch, LLP

(57) ABSTRACT

A multipolar plug-in connection, wherein at least one partially cylindrical metal shell is provided on the connector and accompanying outlet or coupling. A contact spring element is also provided on at least one longitudinal edge of at least one of the partially cylindrical shells. When the plug-in connection is made correctly, the element establishes a contact with the longitudinal edge of adjacent partial cylinder shells in the direction of the periphery.

9 Claims, 2 Drawing Sheets

MULTIPOLAR PLUG-IN CONNECTION

BACKGROUND OF THE INVENTION

This application is the National phase under 35. U.S.C. § 371 of PCT International Application No. PCT/EP99/07843, which has an International filing date of Oct. 15, 1999, which designated the United States of America.

The invention relates to a multipole plug-and-socket connection according to the preamble of the main claim.

Plug-and-socket connections of this kind are known. (Main catalogue of the firm W. W. Fischer SA, Switzerland, 1997 edition). For easy position location when assembling the plug and socket or coupling, either metal semicylindrical shells are to be provided both at the plug and at the socket/coupling, these complementing one another when correctly assembled to form a complete cylinder surrounding the plug-and-socket connection, or, if the intention is to prevent structurally similar plug-and-socket connections from being confused, a plurality of part-cylindrical shells distributed over the circumference are to be provided, for example two quarter-cylindrical shells at the plug and two quarter-cylindrical shells at the socket/coupling (Fischer Catalogue, Section L, page 4: Codings for position location when plugging in).

In order to make plug-and-socket connections of this kind EMC-tight, a metal plug housing is used which on the one hand is electrically connected to the cable screening and which establishes electrical contact with the housing, also consisting of metal, of the socket or coupling when assembled. This earth contact, previously only possible via the plug housing, for the cable screening is complex and not optimum in electrical terms.

The object of the invention is therefore to develop and improve a multipole plug-and-socket connection of the indicated type so as to achieve optimum earth contact between the plug and the socket or coupling both in electrical and mechanical terms.

SUMMARY OF THE INVENTION

Taking a multipole plug-and-socket connection according to the preamble of the main claim as a starting point, this object is solved by the characterising features of this claim. The subclaims comprise advantageous developments.

According to the invention, the metal part-cylindrical shells, which are in any case provided in plug-and-socket connections of this kind for mechanical position location, are modified in a simple and inexpensive manner so as to be simultaneously used to establish electrical earth contact. At least one additional contact spring element is formed for this purpose at least at one of the longitudinal edges of at least one of the part-cylindrical shells, this element establishing electrical cross-contact between the longitudinal edges of the part-cylindrical shells in the assembled state. Therefore all that is required to establish earth contact in the plug-and-socket connection is to establish a metallic connection in the plug between the cable screening and the part-cylindrical shell and to metallically connect, in the associated socket or coupling, the part-cylindrical shell located here to the earth of the device accommodating the socket or to the cable screening adjoining the coupling, as has been standard practice until now where such plugs and sockets or couplings are concerned.

When using the invention in plugs with a metal plug housing which encloses the part-cylindrical shells and is only separated from these by a narrow gap, a slight expansion of the part-cylindrical shells complementing one another to form a complete cylinder is achieved in the assembled state via the contact spring element. The individual part-cylindrical shells are thereby pushed outwards slightly, so that they establish electrical contact with the cylindrical inner surface of the metal plug housing by way of their outer surface. The earth connection between the plug and socket or coupling is improved further as a result.

As the plug housing is no longer needed for earth contact in the plug-and-socket connection according to the invention, it may consist completely of non-conducting plastics material. A plug-and-socket connection according to the invention can be assembled at a very low cost from a few individual parts while still guaranteeing effective and reliable earth contact connection in the assembled state. The contact spring elements establishing the cross-contact between the part-cylindrical shells may be produced in different ways at the longitudinal edge. In the case of small to medium-sized plugs whose part-cylindrical shells consist of thin spring plate, the contact spring element may be produced by a single longitudinal slot extending parallel to the longitudinal edge or by a plurality of short longitudinal slots formed one behind the other in the spring plate shell, with the narrow spring plate web or spring plate webs thereby formed and connected to the shell on one or both sides being bent outwards slightly. In the case of larger plugs whose part-cylindrical shells have thicker walls, the contact spring elements may consist of repeatedly folded plate webs which are worked out of the part-cylindrical shells via slots, or contact spring parts, which are optionally separate, may be inserted in corresponding edge recesses in the part-cylindrical shells.

The contact springs are distributed over the part-cylindrical shells such that no torsional forces are exerted on the part-cylindrical shells used for position location when assembly takes place. With regard to a multipole plug-and-socket connection with semicylindrical shells provided at the plug or socket/coupling, as are most common in practice, contact spring elements are only provided at one of the semicylindrical shells, preferably at that of the plug, this being at both longitudinal edges. This prevents the semicylindrical shells, which complement one another to form a complete cylinder, from turning in one direction upon assembly and then losing the predetermined orientation between the plug pins and the female contacts and therefore no longer guaranteeing the object of exact position location during assembly.

As the mechanical construction provided for position location is maintained in the invention, a plug additionally equipped according to the invention with contact springs is entirely compatible with sockets or plug couplings commonly used until now.

BRIEF DESCRIPTION OF THE DRAWINGS

The invention is illustrated in detail in the following on the basis of an embodiment and with reference to diagrammatic drawings.

DETAILED DESCRIPTION OF THE INVENTION

Figures 1, 2:
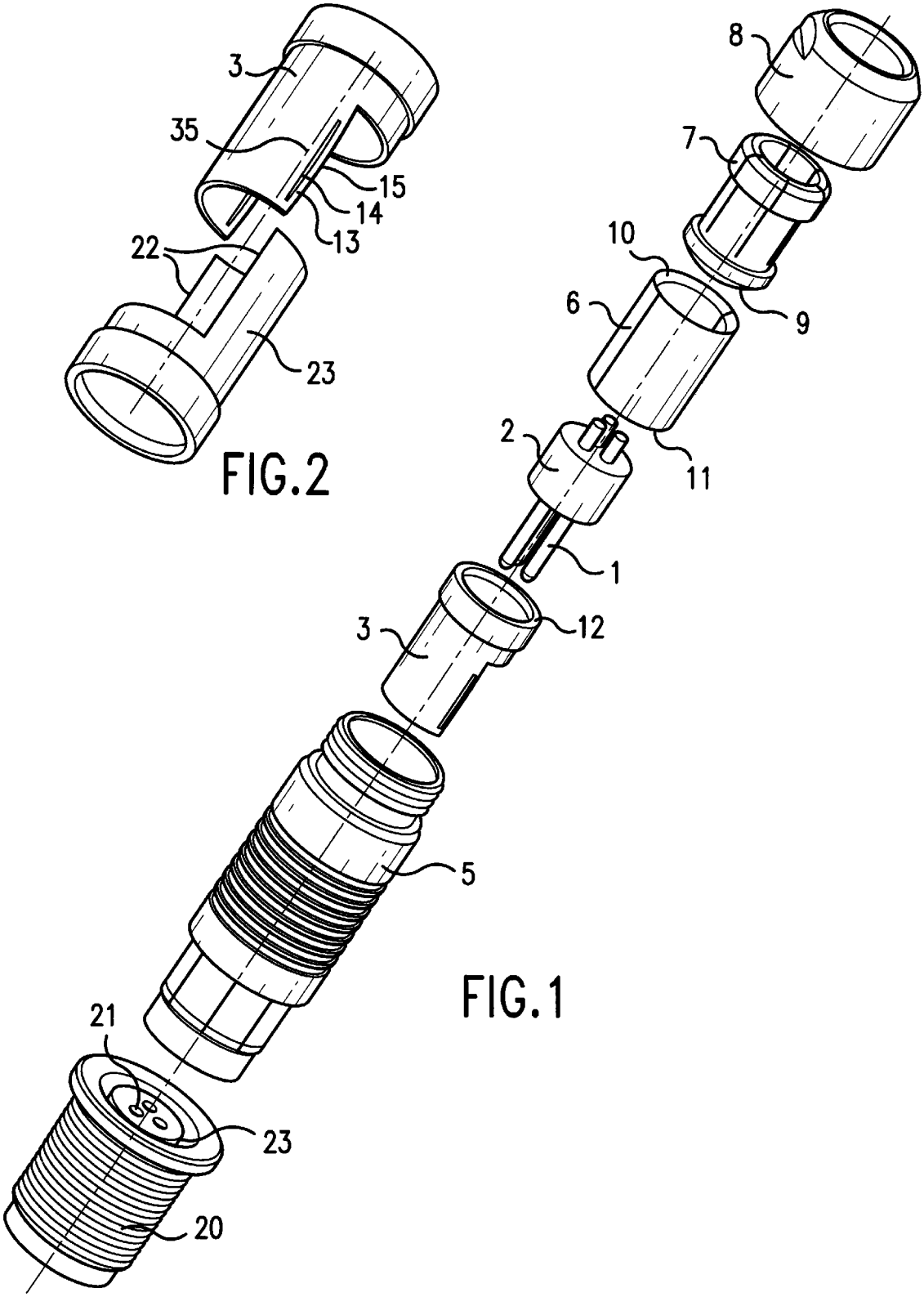
FIG. 1 shows a multipole plug-and-socket connection when pulled apart, consisting of a plug and an associated socket.
FIG. 2 shows in detail the semicylindrical shells according to the invention which are used in this case.

The plug which is represented in FIG. 1 consists of an insulating material body 2 which accommodates the contact pins 1 and over which a metal semicylindrical shell 3 is placed. This construction unit is inserted in a metal cylindrical plug housing 5. In the mounted state the front edge of the semicylindrical shell 3 extends almost to the edge of the plug housing 5. The insulating material body 2 with the semicylindrical shell 3 attached thereto is held in the plug housing 5 by a soldered window sleeve 6, which is pushed inwards by a collet 7 and a clamping nut 8, which is screwed onto the plug housing 5. The connecting cable, which is not shown, is introduced into the plug housing interior through the clamping nut 8 and the collet 7, and the cable screening, which consists of metal braiding, is placed over the conical surface 9 of the collet and clamped between this conical surface 9 and the conical surface 10 of the soldered window sleeve 6 in the assembled state. The other end 11 of the soldered window sleeve 6 presses onto the collar 12 of the semicylindrical shell 3 in the clamped state. There is thus direct metallic contact between the cable screening and the semicylindrical shell 3.

A cylindrical insulating material body with the associated female contacts 21, being disposed in a metal cylindrical socket housing 20, is inserted in the associated socket, which may also be formed as a coupling, represented in the illustrated embodiment, and a metal semicylindrical shell 23 is again attached to the insulating material body as it is to the body 2. If the socket is formed as a coupling, a coupling housing corresponding to the plug housing 5 is provided and the screening of the cable which is attached to the coupling is again metallically connected to the semishell 23 as in the case of the plug.

FIG. 2 is a scaled-up illustration of the co-operation of the two semicylindrical shells 3 and 23, which guarantee exact positioning of the plug pins 1 in relation to the female contacts 21. The plug and socket or coupling can only be assembled when the two semicylindrical shells are in the position represented in FIGS. 1 and 2, and the predetermined association of the plug pins and female contacts only occurs in this position.

According to the invention at least one contact spring element is formed at least at one of the longitudinal edges of at least one of the semicylindrical shells 3 and 23. In the illustrated embodiment the semicylindrical shell 3 of the plug consists of spring plate, and a contact spring 13 is in each case formed at both of its longitudinal edges 22, which spring is arched outwards slightly and establishes contact with the longitudinal edges 22 of the semicylindrical shell 23 of the socket in the assembled state. In the embodiment according to FIGS. 1 and 2 this contact spring 13 is formed by a longitudinal slot 14 which extends parallel to the longitudinal edge 22, the resulting narrow web 15, which is connected at both ends to the semicylindrical shell 3,. is arched outwards slightly and forms the contact spring 13. The longitudinal slot 14 could also be open at one end, preferably at the end facing the collar 12, so as to produce a contact spring which is only attached to the semishell 3 on one side, in which case, however, steps must be taken to ensure that the spring does not hook onto the mating piece when the plug-and-socket connection is disengaged. A plurality of short spring elements which are either closed or open on one side could also be formed one behind the other along the longitudinal edges 22 according to the same principle. In order to achieve a completely HF-tight screening for some applications, the longitudinal slot 14 or the plurality of successive longitudinal slots could also be filled with or covered (bridged) by a flexible conductive material 35 such as an inserted metal foil material or a conductive elastic silicone material.

This additional contact spring 13 at the edge of the semishells establishes effective electrical contact between the longitudinal edges 22 of the semicylindrical shells 3 and 23 and thus effective and defined earth contact between the cable screening and the housing accommodating the socket or the cable screening of a coupling in the assembled state. The plug housing 5 does not need to be formed from metal, it could consist completely of a plastics material. However if a metal plug housing is provided for other reasons, the measure according to the invention has the additional advantage of the two semicylindrical shells 3 and 23 being expanded slightly in the radial direction by the contact springs 13 and additional earth contact thereby being established between the cylindrical inside of the metal housing 5 and the outside of the semicylindrical shells 3 and 23.

Figure 3:
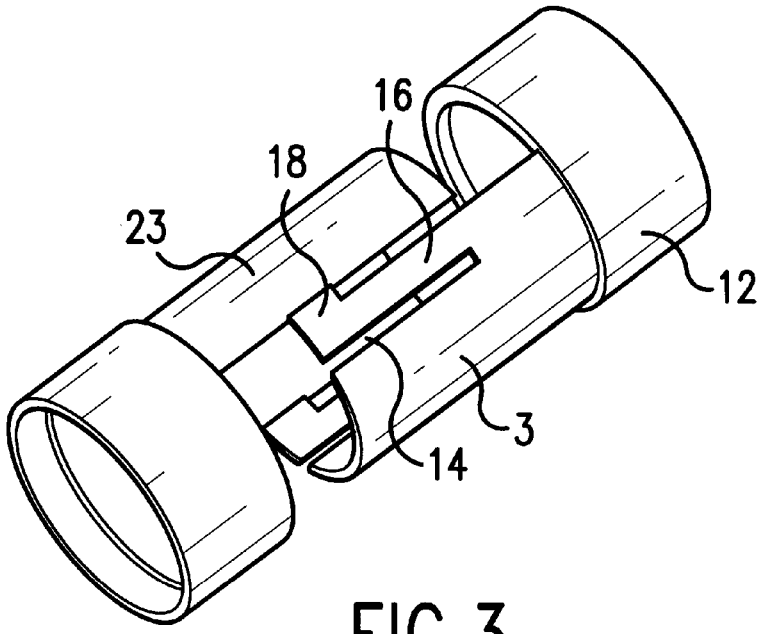
FIGS. 3 and 4 show further embodiments for the formation of the contact spring elements.
Figure 4:
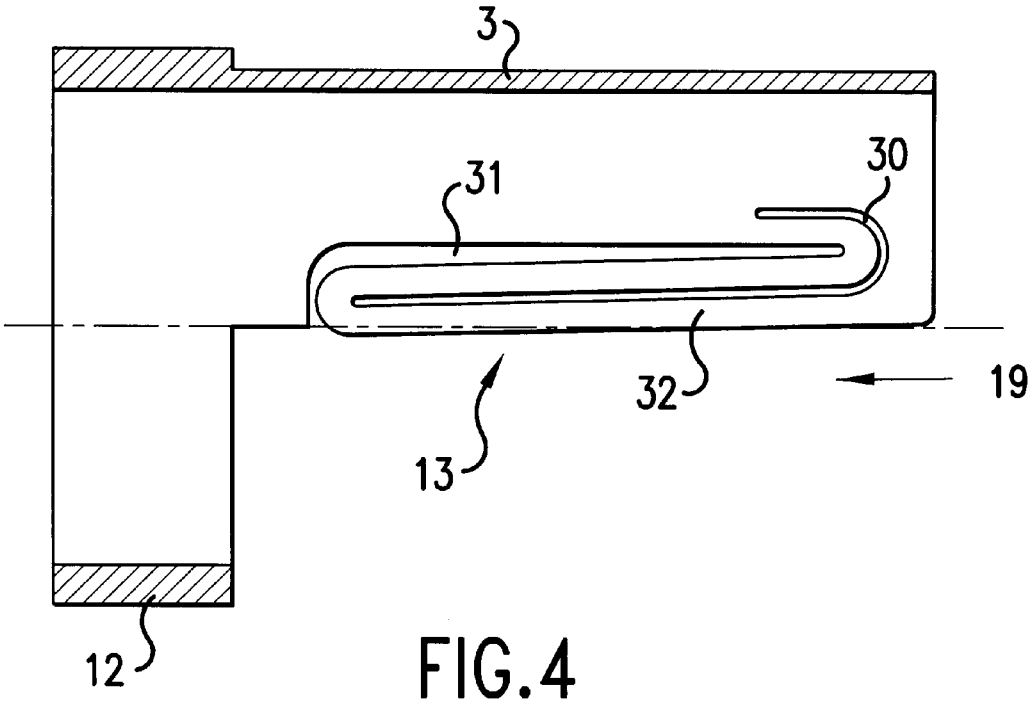

FIG. 3 shows a further embodiment for the formation of the contact spring element 13, which again is formed by a slot 14 in the semicylindrical shell 3 of the plug. The slot 14 is open at the front, thereby producing a plate web 16 which is only located on one side of the semicylindrical shell 3 and whose end which leads in the plug-in direction is widened to form a contact 18. However this type of contact spring element is only suitable for plug-and-socket connections in which the plate web, which protrudes freely forwards, does not impair the position location process when assembling the plug and socket/coupling. In this respect it is of greater advantage to form the contact spring element 13 according to FIG. 4, as in this case the open slot faces the rear in the plug-in direction 19, i.e. the collar 12, so that the plate web cannot become hooked. Increased spring force is achieved in the embodiment according to FIG. 4 by working a repeatedly folded plate web 32 out of the semicylindrical shell 3 via U-shaped slots 30, 31, which web, although being connected at both ends to the semicylindrical shell 3, nevertheless acts as a spring element which is only attached to the semicylindrical shell 3 on one side.

The measure according to the invention can be used with a wide variety of multipole plug-and-socket connectors of any desired size, also with mixed-component plug-and-socket connectors having coaxial cables, light guides, thermocouples, etc. (Fischer Catalogue, Sections E to G).

What is claimed is:

1. Multipole plug-and-socket connector, in which at least a first metal part-cylindrical shell is provided at a plug and a second metal part-cylindrical shell is provided at an associated socket, each of said first and second metal part-cylindrical shells respectively having first and second longitudinal edges that are adjoining one another in a circumferential direction in a correctly assembled state in which the plug is engaged with the socket, wherein a contact spring element is formed at least at said first longitudinal edge of said first part-cylindrical shell, which contact spring element establishes contact with said first longitudinal edge of the second part-cylindrical shell, wherein at least one longitudinal slot in the first part-cylindrical shell forms the contact spring element and wherein said at least one longitudinal slot is filled or covered by a flexible element of a conductive material.

2. Plug-and-socket connector according to claim 1, wherein there are at least two contact spring elements, one formed at each of the first and second longitudinal edges of the first part-cylindrical shell.

3. Plug-and-socket connector according to claim 1, wherein the contact spring element is formed by a plurality of plate webs disposed one behind the other along the longitudinal edge of the first part-cylindrical shell.

4. Plug-and-socket connector according to claim 1, wherein is further included a housing of metal in which the first and second part-cylindrical shells are located in the correctly assembled state and outer surfaces of the first and second part-cylindrical shells are expanded slightly in the radial direction by the contact spring element to establish contact with the inside of the plug housing in the correctly assembled state.

5. Plug-and-socket connector according to claim 1, wherein is further included a housing of insulating material in which the first and second part-cylindrical shells are located and wherein an electrical earth contact for a cable screening is established directly via cross-contact between the respective first longitudinal edges of the first and second part-cylindrical shells which is produced by the contact spring element.

6. Plug-and-socket connector according to claim 1, wherein the contact spring element comprises at least one plate web worked out of the first part-cylindrical shell.

7. Plug-and-socket connector according to claim 6, wherein the plate web is connected to the first part-cylindrical shell at both ends.

8. Plug-and-socket connector according to claim 6, wherein the plate web is connected to the first part-cylindrical shell just at one end, said one end being at the rear in a plug-in direction.

9. Plug-and-socket connector according to claim 6, wherein the contact spring element comprises a repeatedly folded plate web which is worked out of the first part-cylindrical shell via longitudinal slots.

* * * * *